US011324382B2

(12) United States Patent
Durham

(10) Patent No.: US 11,324,382 B2
(45) Date of Patent: May 10, 2022

(54) DIVERTER ASSEMBLY FOR A DISHWASHER APPLIANCE AND A METHOD OF OPERATING THE SAME

(71) Applicant: Haier US Appliance Solutions, Inc., Wilmington, DE (US)

(72) Inventor: Kyle Edward Durham, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 36 days.

(21) Appl. No.: 16/797,435

(22) Filed: Feb. 21, 2020

(65) Prior Publication Data

US 2021/0259510 A1 Aug. 26, 2021

(51) Int. Cl.

| | |
|---|---|
| ***A47L 15/42*** | (2006.01) |
| ***A47L 15/23*** | (2006.01) |
| *A47L 15/00* | (2006.01) |

(52) U.S. Cl.

CPC ..... *A47L 15/4221* (2013.01); *A47L 15/23* (2013.01); *A47L 15/4225* (2013.01); *A47L 15/0049* (2013.01); *A47L 2401/24* (2013.01); *A47L 2501/03* (2013.01); *A47L 2501/26* (2013.01)

(58) Field of Classification Search

CPC .. A47L 15/4221; A47L 15/23; A47L 15/4225; A47L 2401/24; A47L 2501/03; A47L 2501/26; A47L 15/0049

See application file for complete search history.

(56) References Cited

U.S. PATENT DOCUMENTS

| | | | | |
|---|---|---|---|---|
| 7,350,527 | B2 | 4/2008 | Gurubatham et al. | |
| 8,858,729 | B2 | 10/2014 | Boyer | |
| 9,220,393 | B2 | 12/2015 | Becker | |
| 9,763,552 | B2 | 9/2017 | Chapman et al. | |
| 9,936,850 | B2 | 4/2018 | Becker et al. | |
| 10,010,235 | B2 | 7/2018 | Gephart et al. | |
| 2004/0173249 | A1* | 9/2004 | Assmann | F16K 15/188 134/94.1 |
| 2006/0118148 | A1* | 6/2006 | Jeong | A47L 15/4204 134/58 D |
| 2010/0012160 | A1* | 1/2010 | Jeong | A47L 15/4204 134/111 |
| 2010/0139698 | A1* | 6/2010 | Gnadinger | A47L 15/23 134/25.2 |
| 2010/0139719 | A1* | 6/2010 | Gnadinger | A47L 15/4282 134/56 D |
| 2012/0048313 | A1 | 3/2012 | Armstrong | |
| 2016/0316992 | A1 | 11/2016 | Lee et al. | |
| 2019/0099054 | A1 | 4/2019 | Digman et al. | |

FOREIGN PATENT DOCUMENTS

| | | |
|---|---|---|
| EP | 0844422 A2 | 5/1998 |

* cited by examiner

*Primary Examiner* — Benjamin L Osterhout

(74) *Attorney, Agent, or Firm* — Dority & Manning, P.A.

(57) ABSTRACT

A dishwasher appliance includes a sump that collects wash fluid and a circulation pump for urging the wash fluid through a supply conduit to a plurality of spray arms. A diverter assembly is operably coupled to the supply conduit for selectively diverting the flow of wash fluid to the plurality of spray arms and a rotation detection system monitors rotation of the spray arms. A controller detects rotation of the plurality of spray arms and determines a position of the diverter assembly based on the rotation.

20 Claims, 5 Drawing Sheets

DIVERTER ASSEMBLY FOR A DISHWASHER APPLIANCE AND A METHOD OF OPERATING THE SAME

FIELD OF THE INVENTION

The present disclosure relates generally to dishwasher appliances, and more particularly to diverter assemblies within dishwasher appliances.

BACKGROUND OF THE INVENTION

Dishwasher appliances generally include a tub that defines a wash chamber. Rack assemblies can be mounted within the wash chamber of the tub for receipt of articles for washing. Wash fluid (e.g., various combinations of water and detergent along with optional additives) may be introduced into the tub where it collects in a sump space at the bottom of the wash chamber. During wash and rinse cycles, a pump may be used to circulate wash fluid to spray assemblies within the wash chamber that can apply or direct wash fluid towards articles disposed within the rack assemblies in order to clean such articles. During a drain cycle, a drain pump may periodically discharge soiled wash fluid that collects in the sump space and the process may be repeated.

Conventional dishwashers include fluid diverters that direct wash fluid to various spray arms throughout the wash chamber. Conventional diverters include a position sensor that is built into the diverting mechanism for providing feedback regarding the diverter position. For example, the position sensor may include bimodal switches that change state depending on the position of the diverting mechanism. However, it may frequently be desirable to avoid the use of such position sensors within the diverter, e.g., for reducing parts, cost, labor, or component quality. Alternative methods of diverter control include spraying equal time in all modes, configuring the diverter to reset based upon circulation pump status, pressure sensor(s) within the hydraulic system, etc. However, these alternative methods of diverter position detection are frequently complex, costly, or ineffective.

Accordingly, a dishwasher appliance with an improved diverter assembly would be desirable. More specifically, a diverter assembly that does not rely on an internal position sensor would be particularly beneficial.

BRIEF DESCRIPTION OF THE INVENTION

Aspects and advantages of the invention will be set forth in part in the following description, or may be apparent from the description, or may be learned through practice of the invention.

In a first example embodiment, a dishwasher appliance is provided including a wash tub that defines a wash chamber, a sump for collecting wash fluid, and a circulation pump in fluid communication with the sump for urging a flow of wash fluid through a supply conduit. A plurality of spray arms are rotatably mounted within the wash chamber, a diverter assembly is operably coupled to the supply conduit for selectively diverting the flow of wash fluid to the plurality of spray arms, and a rotation detection system is provided for detecting rotation of the plurality of spray arms. A controller is in operative communication with the rotation detection system and is configured for detecting rotation of the plurality of spray arms using the rotation detection system and determining a position of the diverter assembly based at least in part on the rotation detected by the rotation detection system.

In a second example embodiment, a fluid circulation assembly for a dishwasher appliance is provided. The dishwasher appliance includes a sump for collecting wash fluid and the fluid circulation assembly includes a supply conduit fluidly coupled to the sump, a plurality of spray arms rotatably mounted within the wash tub and being fluidly coupled to the supply conduit, and a pump for urging a flow of wash fluid from the sump through the supply conduit. A rotation detection system is provided for detecting rotation of the plurality of spray arms and a diverter assembly is operably coupled to the supply conduit. The diverter assembly includes a diverter housing defining a diverter chamber and a plurality of outlets, each outlet being fluidly coupled with one of the plurality of spray arms and a diverter disc rotatably mounted within the diverter chamber and being movable to a plurality of positions for selectively directing the flow of wash fluid to the plurality of spray arms.

In a second example embodiment, a method of determining a position of a diverter assembly in a dishwasher appliance is provided. The method includes detecting rotation of a plurality of spray arms using a rotation detection system and determining the position of the diverter assembly based at least in part on the rotation detected by the rotation detection system.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

Figure 1:
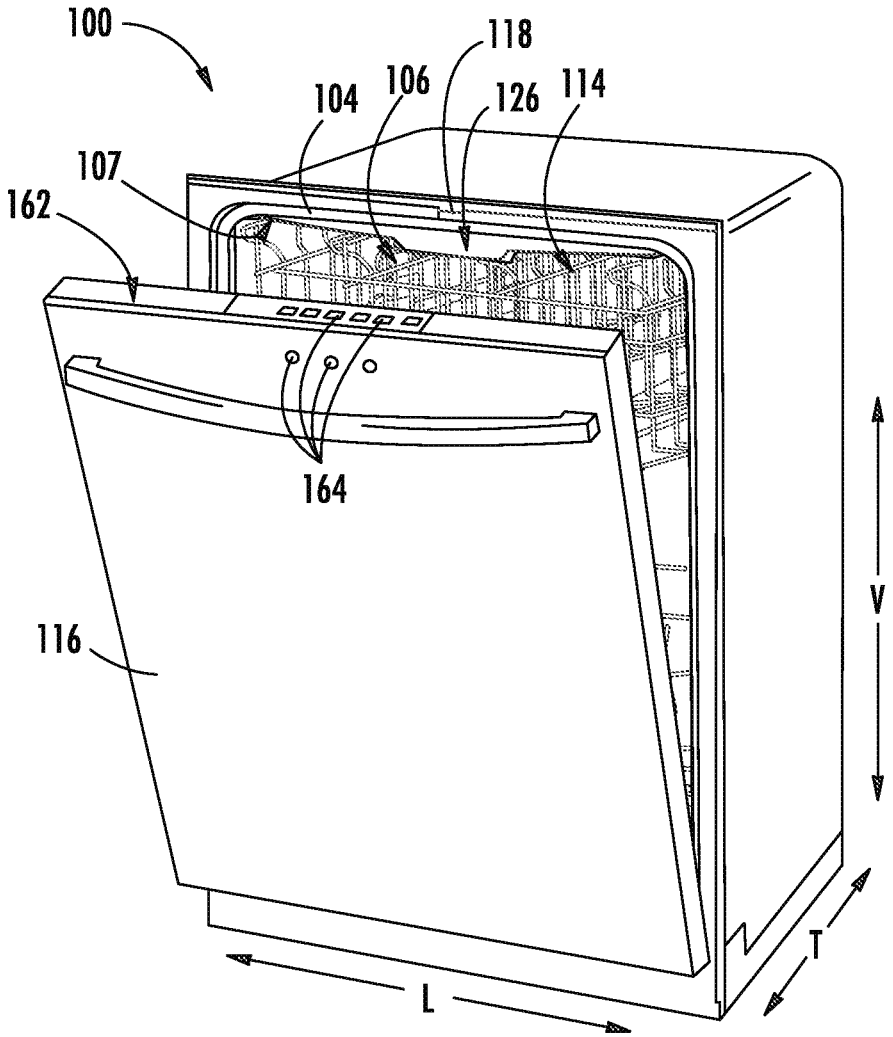
FIG. 1 provides a perspective view of an exemplary embodiment of a dishwashing appliance of the present disclosure with a door in a partially open position.

Repeat use of reference characters in the present specification and drawings is intended to represent the same or analogous features or elements of the present invention.

DETAILED DESCRIPTION OF THE INVENTION

Reference now will be made in detail to embodiments of the invention, one or more examples of which are illustrated in the drawings. Each example is provided by way of explanation of the invention, not limitation of the invention.

In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "article" may refer to, but need not be limited to dishes, pots, pans, silverware, and other cooking utensils and items that can be cleaned in a dishwashing appliance. The term "wash cycle" is intended to refer to one or more periods of time during which a dishwashing appliance operates while containing the articles to be washed and uses a detergent and water, preferably with agitation, to e.g., remove soil particles including food and other undesirable elements from the articles. The term "rinse cycle" is intended to refer to one or more periods of time during which the dishwashing appliance operates to remove residual soil, detergents, and other undesirable elements that were retained by the articles after completion of the wash cycle. The term "drain cycle" is intended to refer to one or more periods of time during which the dishwashing appliance operates to discharge soiled water from the dishwashing appliance. The term "wash fluid" refers to a liquid used for washing and/or rinsing the articles and is typically made up of water that may include other additives such as detergent or other treatments. Furthermore, as used herein, terms of approximation, such as "approximately," "substantially," or "about," refer to being within a ten percent margin of error.

Figure 2:
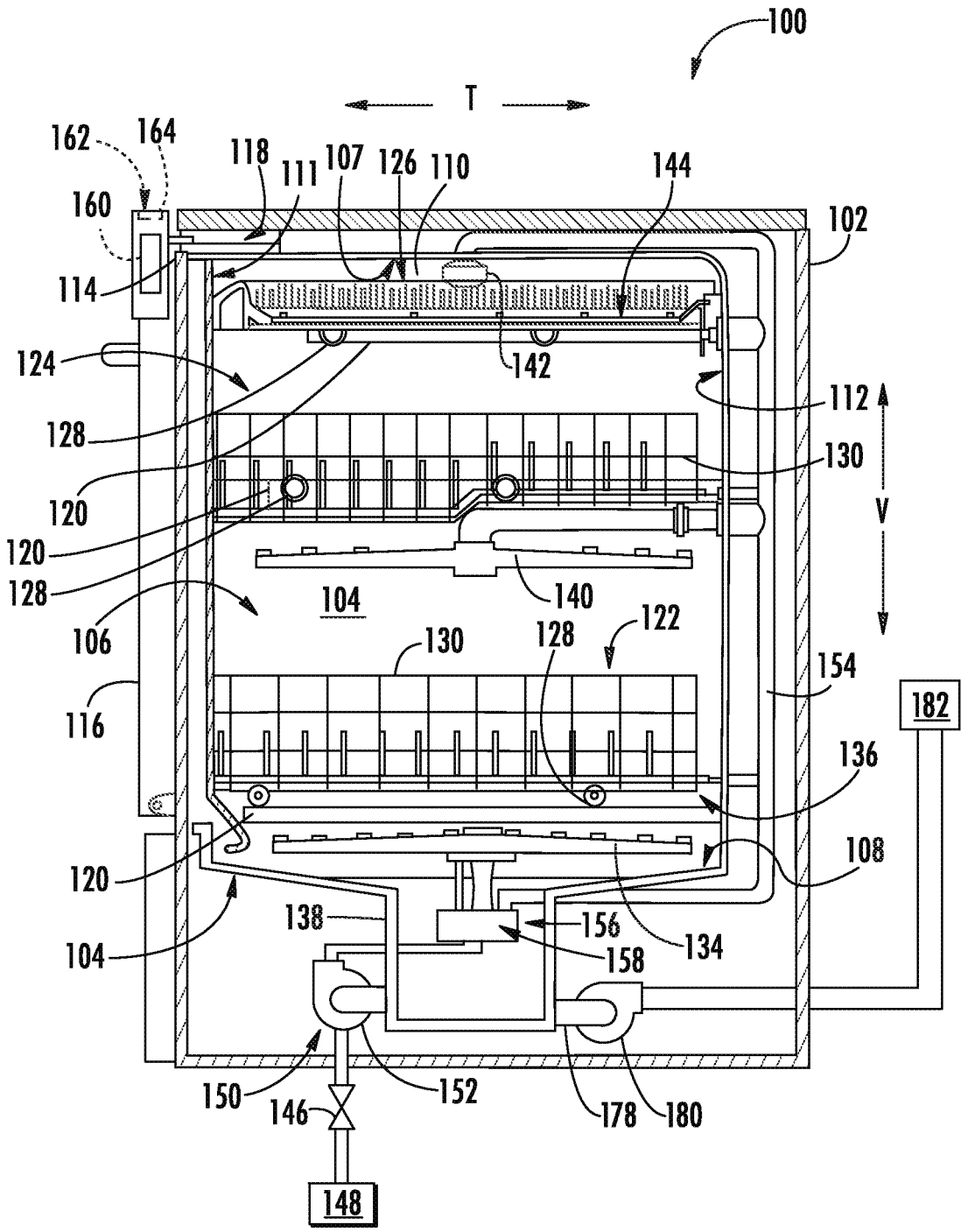
FIG. 2 provides a side, cross sectional view of the exemplary dishwashing appliance of FIG. 1.

FIGS. 1 and 2 depict an exemplary domestic dishwasher or dishwashing appliance 100 that may be configured in accordance with aspects of the present disclosure. For the particular embodiment of FIGS. 1 and 2, the dishwasher 100 includes a cabinet 102 (FIG. 2) having a tub 104 therein that defines a wash chamber 106. As shown in FIG. 2, tub 104 extends between a top 107 and a bottom 108 along a vertical direction V, between a pair of side walls 110 along a lateral direction L, and between a front side 111 and a rear side 112 along a transverse direction T. Each of the vertical direction V, lateral direction L, and transverse direction T are mutually perpendicular to one another.

The tub 104 includes a front opening 114 and a door 116 hinged at its bottom for movement between a normally closed vertical position (shown in FIG. 2), wherein the wash chamber 106 is sealed shut for washing operation, and a horizontal open position for loading and unloading of articles from the dishwasher 100. According to exemplary embodiments, dishwasher 100 further includes a door closure mechanism or assembly 118 that is used to lock and unlock door 116 for accessing and sealing wash chamber 106.

As best illustrated in FIG. 2, tub side walls 110 accommodate a plurality of rack assemblies. More specifically, guide rails 120 may be mounted to side walls 110 for supporting a lower rack assembly 122, a middle rack assembly 124, and an upper rack assembly 126. As illustrated, upper rack assembly 126 is positioned at a top portion of wash chamber 106 above middle rack assembly 124, which is positioned above lower rack assembly 122 along the vertical direction V. Each rack assembly 122, 124, 126 is adapted for movement between an extended loading position (not shown) in which the rack is substantially positioned outside the wash chamber 106, and a retracted position (shown in FIGS. 1 and 2) in which the rack is located inside the wash chamber 106. This is facilitated, for example, by rollers 128 mounted onto rack assemblies 122, 124, 126, respectively. Although a guide rails 120 and rollers 128 are illustrated herein as facilitating movement of the respective rack assemblies 122, 124, 126, it should be appreciated that any suitable sliding mechanism or member may be used according to alternative embodiments.

Some or all of the rack assemblies 122, 124, 126 are fabricated into lattice structures including a plurality of wires or elongated members 130 (for clarity of illustration, not all elongated members making up rack assemblies 122, 124, 126 are shown in FIG. 2). In this regard, rack assemblies 122, 124, 126 are generally configured for supporting articles within wash chamber 106 while allowing a flow of wash fluid to reach and impinge on those articles, e.g., during a cleaning or rinsing cycle. According to another exemplary embodiment, a silverware basket (not shown) may be removably attached to a rack assembly, e.g., lower rack assembly 122, for placement of silverware, utensils, and the like, that are otherwise too small to be accommodated by rack 122.

Dishwasher 100 further includes a plurality of spray assemblies for urging a flow of water or wash fluid onto the articles placed within wash chamber 106. More specifically, as illustrated in FIG. 2, dishwasher 100 includes a lower spray arm assembly 134 disposed in a lower region 136 of wash chamber 106 and above a sump 138 so as to rotate in relatively close proximity to lower rack assembly 122. Similarly, a mid-level spray arm assembly 140 is located in an upper region of wash chamber 106 and may be located below and in close proximity to middle rack assembly 124. In this regard, mid-level spray arm assembly 140 may generally be configured for urging a flow of wash fluid up through middle rack assembly 124 and upper rack assembly 126. Additionally, an upper spray assembly 142 may be located above upper rack assembly 126 along the vertical direction V. In this manner, upper spray assembly 142 may be configured for urging and/or cascading a flow of wash fluid downward over rack assemblies 122, 124, and 126. As further illustrated in FIG. 2, upper rack assembly 126 may further define an integral spray manifold 144, which is generally configured for urging a flow of wash fluid substantially upward along the vertical direction V through upper rack assembly 126.

Dishwasher 100 may further include a water supply valve 146 positioned between an external water supply 148 and a circulation pump (such as pump 152 described below) to selectively allow water to flow from the external water supply 148 into circulation pump 152. Additionally or alternatively, water supply valve 146 can be positioned between the external water supply 148 and sump 138 to selectively allow water to flow from the external water supply 148 into sump 138. Water supply valve 146 can be selectively controlled to open and allow the flow of water into dishwasher 100 and can be selectively controlled to cease the flow of water into dishwasher 100.

The various spray assemblies, manifolds, and water supplies described herein may be part of a fluid distribution system or fluid circulation assembly 150 for circulating water and wash fluid in the tub 104. More specifically, fluid circulation assembly 150 includes a pump 152 for circulating water and wash fluid (e.g., detergent, water, and/or rinse aid) in the tub 104. Pump 152 may be located within sump 138 or within a machinery compartment located below sump 138 of tub 104, as generally recognized in the art. Fluid circulation assembly 150 may include one or more fluid conduits or circulation piping for directing water and/or wash fluid from pump 152 to the various spray assemblies and manifolds, e.g., during wash and/or rinse cycles. For example, as illustrated in FIG. 2, a primary supply conduit 154 may extend from pump 152, along rear 112 of tub 104 along the vertical direction V to supply wash fluid throughout wash chamber 106.

As illustrated, primary supply conduit 154 is used to supply wash fluid to one or more spray assemblies, e.g., to mid-level spray arm assembly 140 and upper spray assembly 142. However, it should be appreciated that according to alternative embodiments, any other suitable plumbing configuration may be used to supply wash fluid throughout the various spray manifolds and assemblies described herein. For example, according to another exemplary embodiment, primary supply conduit 154 could be used to provide wash fluid to mid-level spray arm assembly 140 and a dedicated secondary supply conduit (not shown) could be utilized to provide wash fluid to upper spray assembly 142. Other plumbing configurations may be used for providing wash fluid to the various spray devices and manifolds at any location within dishwasher appliance 100.

Each spray arm assembly 134, 140, 142, integral spray manifold 144, or other spray device may include an arrangement of discharge ports or orifices for directing wash fluid received from pump 152 onto dishes or other articles located in wash chamber 106. The arrangement of the discharge ports, also referred to as jets, apertures, or orifices, may provide a rotational force by virtue of wash fluid flowing through the discharge ports. Alternatively, spray arm assemblies 134, 140, 142 may be motor-driven, or may operate using any other suitable drive mechanism. Spray manifolds and assemblies may also be stationary. The resultant movement of the spray arm assemblies 134, 140, 142 and the spray from fixed manifolds provides coverage of dishes and other dishwasher contents with a washing spray. Other configurations of spray assemblies may be used as well. For example, dishwasher 100 may have additional spray assemblies for cleaning silverware, for scouring casserole dishes, for spraying pots and pans, for cleaning bottles, etc. One skilled in the art will appreciate that the embodiments discussed herein are used for the purpose of explanation only, and are not limitations of the present subject matter.

In operation, pump 152 draws wash fluid in from sump 138 and pumps it to a diverter assembly 156, e.g., which is positioned within sump 138 of dishwasher appliance. Diverter assembly 156 may include a diverter disk (not shown) disposed within a diverter chamber 158 for selectively distributing the wash fluid to the spray arm assemblies 134, 140, 142 and/or other spray manifolds or devices. For example, the diverter disk may have a plurality of apertures that are configured to align with one or more outlet ports (not shown) at the top of diverter chamber 158. In this manner, the diverter disk may be selectively rotated to provide wash fluid to the desired spray device.

According to an exemplary embodiment, diverter assembly 156 is configured for selectively distributing the flow of wash fluid from pump 152 to various fluid supply conduits, only some of which are illustrated in FIG. 2 for clarity. More specifically, diverter assembly 156 may include four outlet ports (not shown) for supplying wash fluid to a first conduit for rotating lower spray arm assembly 134, a second conduit for rotating mid-level spray arm assembly 140, a third conduit for spraying upper spray assembly 142, and a fourth conduit for spraying an auxiliary rack such as the silverware rack.

The dishwasher 100 is further equipped with a controller 160 to regulate operation of the dishwasher 100. The controller 160 may include one or more memory devices and one or more microprocessors, such as general or special purpose microprocessors operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 160 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software.

The controller 160 may be positioned in a variety of locations throughout dishwasher 100. In the illustrated embodiment, the controller 160 may be located within a control panel area 162 of door 116 as shown in FIGS. 1 and 2. In such an embodiment, input/output ("I/O") signals may be routed between the control system and various operational components of dishwasher 100 along wiring harnesses that may be routed through the bottom of door 116. Typically, the controller 160 includes a user interface panel/controls 164 through which a user may select various operational features and modes and monitor progress of the dishwasher 100. In one embodiment, the user interface 164 may represent a general purpose I/O ("GPIO") device or functional block. In one embodiment, the user interface 164 may include input components, such as one or more of a variety of electrical, mechanical or electro-mechanical input devices including rotary dials, push buttons, and touch pads. The user interface 164 may include a display component, such as a digital or analog display device designed to provide operational feedback to a user. The user interface 164 may be in communication with the controller 160 via one or more signal lines or shared communication busses.

It should be appreciated that the invention is not limited to any particular style, model, or configuration of dishwasher 100. The exemplary embodiment depicted in FIGS. 1 and 2 is for illustrative purposes only. For example, different locations may be provided for user interface 164, different configurations may be provided for rack assemblies 122, 124, 126, different spray arm assemblies 134, 140, 142 and spray manifold configurations may be used, and other differences may be applied while remaining within the scope of the present subject matter.

Figure 3:
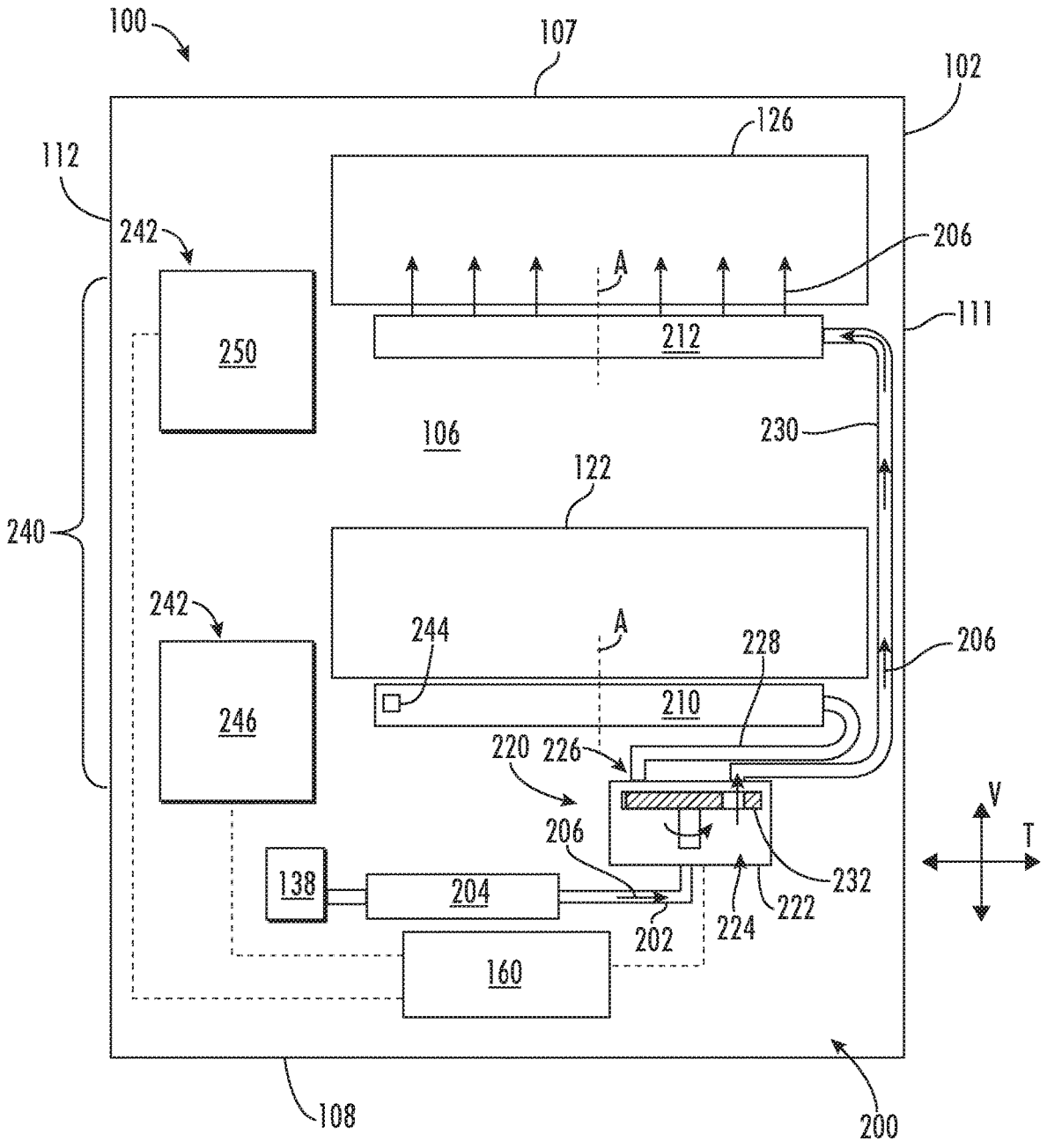
FIG. 3 provides a schematic view of a fluid circulation assembly of the exemplary dishwashing appliance of FIG. 1 according to an example embodiment of the present subject matter.
Figure 4:
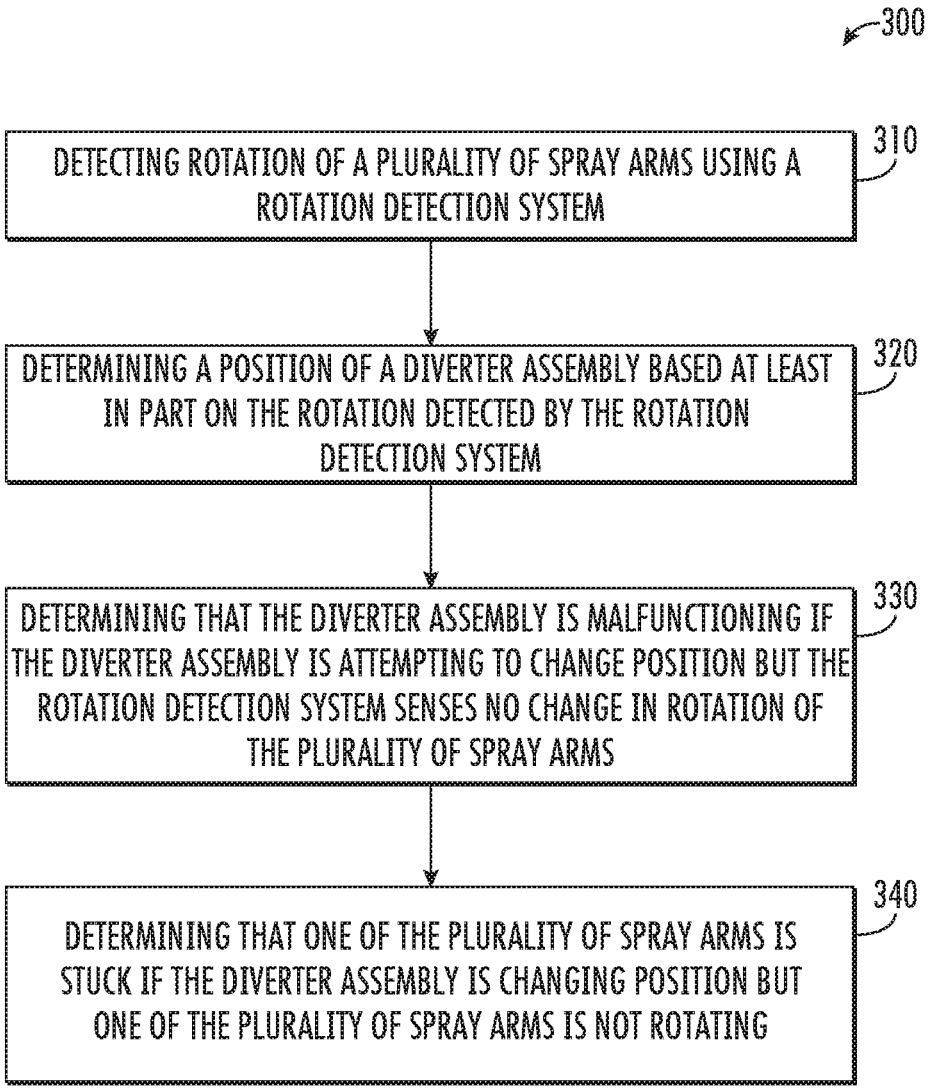
FIG. 4 provides a method of determining a position of a diverter assembly in the exemplary dishwasher appliance of FIG. 1 according to an exemplary embodiment.

Referring now generally to FIGS. 3 and 4, sump 138 of dishwasher appliance 100 may include a drain basin 170 coupled to a bottom wall 172 of tub 104 by a cylindrical sidewall 174. During operation of dishwasher appliance 100, wash fluid 176 is directed toward sump 138 where it falls into drain basin 170 and is collected and contained by cylindrical sidewall 174. As shown, circulation pump 152 may be fluidly coupled to sump 138, e.g., through a port defined within cylindrical sidewall 174 such that circulation pump 152 may draw wash fluid 176 from sump 138 for circulation within dishwasher appliance 100. In addition, as shown for example in FIG. 2, a drain conduit 178 may be fluidly coupled to drain basin 170 and a drain pump 180 may be fluidly coupled to drain conduit 178 for selectively discharging wash fluid 176 from washing machine appliance, e.g., to an external drain 182.

Referring now to FIG. 3, a fluid circulation assembly 200 will be described according to exemplary embodiments of the present subject matter. It should be appreciated that fluid circulation assembly 200 may be similar to or the same as fluid circulation assembly 150. Therefore, similar reference numerals may be used to refer to the same or similar features. It should be appreciated that fluid circulation assembly 200 is described and illustrated herein only to facilitate explanation of aspects of the present subject matter. Variations and modifications may be made to fluid circulation assembly 200 while remaining within the scope of the present subject matter.

As shown, fluid circulation assembly 200 includes a supply conduit 202 (e.g., similar to primary supply conduit 154) that is fluidly coupled to sump 138. A circulation pump 204, such as pump 152 may be fluidly coupled to supply conduit for urging a flow of wash fluid (e.g., as indicated by reference numeral 206 in FIG. 3) throughout fluid circulation assembly 200 and wash chamber 106. During operation of dishwasher appliance 100, circulation pump 204 draws wash fluid 206 from sump 138, through supply conduit 202, and provides it to one or more spray arms located within wash chamber 106. Specifically, according to the illustrated embodiment of FIG. 3, fluid circulation assembly 200 includes a first spray arm or lower spray arm 210 and a second spray arm or upper spray arm 212. According to exemplary embodiments, lowers spray arm 210 and upper spray arm 212 are both rotatable about an axis A. It should be appreciated that according to alternative embodiments, any other suitable number, size, position, and configuration of spray arms may be used while remaining within the scope of the present subject matter.

Referring still to FIG. 3, dishwasher appliance 100 may include a diverter assembly 220 (e.g., similar to diverter assembly 156) that is fluidly coupled to supply conduit 202 and is configured for selectively directing the flow of wash fluid 206 to one or more of lower spray arm 210 and upper spray arm 212. According to exemplary embodiments, controller 160 may be communicatively coupled to diverter assembly 220 for adjusting the position of diverter assembly 220 and directing the flow of wash fluid to the desired spray arm 210, 212.

According to exemplary embodiments, diverter assembly 220 includes a diverter housing 222 that defines a diverter chamber 224 having a plurality of outlets 226. Each outlet 226 is fluidly coupled to one of the lower spray arm 210 and upper spray arm 212, e.g., via a lower supply conduit 228 and an upper supply conduit 230, respectively. A diverter disk 232 is rotatably mounted within diverter chamber 224 and is movable (i.e., rotatable) between a first position for directing the flow of wash fluid 206 through lower supply conduit 228 to lower spray arm 210 and a second position for directing the flow of wash fluid 206 through upper supply conduit 230 to upper spray arm 212. Although diverter assembly 220 is described herein as having two outlets 226 for supplying wash fluid to two supply conduits 228, 230, it should be appreciated that the configuration and number of spray arms supplied by diverter assembly 220 may vary according to alternative embodiments. Furthermore, although a rotating disk diverter design is described here according to an exemplary embodiment, it should be appreciated that other diverter designs may be used while remaining within the scope of the present subject matter.

Referring still to FIG. 3, fluid circulation assembly 200 may include a rotation detection system 240 that is generally configured for detecting rotation of spray arms 210, 212. In this regard, for example, rotation detection system 240 may include a plurality of rotation sensors (e.g., as identified generally by reference numeral 242 in FIG. 3). Each of the rotation sensors 242 may be operably coupled with a single spray arm, e.g., lower spray 210 or upper spray arm 212, for detecting rotation of that particular spray arm.

Rotation sensors 242 may generally be any suitable type or configuration of sensor or device capable of monitoring the rotation of lower spray arm 210 and upper spray 212. For example, according to the illustrated embodiment, the rotation sensor 242 for lower spray arm 210 may be a magnetic rotation sensor. In this regard, for example, lower spray arm 210 may include a magnet 244 that is embedded in the distal end of lower spray arm 210. In addition, a reed switch 246 may be mounted at a fixed location on a back side (i.e., rear 112) of wash tub 104. In this manner, as lower spray arm 210 rotates and causes magnet 244 to pass by a reed switch 246, reed switch 246 is triggered and controller 160 may monitor the frequency at which reed switch 246 is triggered to determine the rotation speed of lower spray arm 210.

By contrast, rotation sensor 242 for upper spray arm 212 may be an optical speed sensor. In this regard, rotation sensor 242 for upper spray arm 212 may include an optical emitter and/or receiver 250 that emits a beam of light and determines the position of upper spray arm 212 based on the interruption of that beam of light or the reflection of that beam of light. Thus, for example, rotation sensor 242 for upper spray 212 may be an optical encoder, a tachometer, or an interruption-based sensor. Although two exemplary speed sensor types are described herein, it should be appreciated that according to alternative embodiments, the same or similar speed sensors may be used throughout wash chamber 106. In addition, although rotation sensors 242 are illustrated as being positioned proximate a rear 112 of wash tub 104, it should be appreciated that according to alternative embodiments, any other suitable position of such rotation sensors 242 may be used.

In addition, it should be appreciated that controller 160 may be in operative communication with each of the plurality of rotation sensors 242 for monitoring the rotation of spray arms 210, 212. Specifically, as described in more detail below, controller 160 may generally be configured for monitoring the rotation of lower spray arm 210 and upper spray arm 212. In addition, controller 160 may determine a position of diverter assembly 220 based at least in part in the rotation detected by rotation sensors 242. Notably, detecting the diverter position in this manner may eliminate the need for an internal position detector within the diverter assembly 220, which may result in additional costs, increased complexity, and decreased reliability.

Now that the construction of dishwasher appliance 100 and the configuration of controller 160 according to exemplary embodiments have been presented, an exemplary method 300 of operating a dishwasher appliance will be described. Although the discussion below refers to the exemplary method 300 of operating dishwasher appliance 100, one skilled in the art will appreciate that the exemplary method 300 is applicable to the operation of a variety of other dishwasher appliances or other suitable appliances. In exemplary embodiments, the various method steps as disclosed herein may be performed by controller 160 or a separate, dedicated controller.

Referring now to FIG. 4, method 300 includes, at step 310, detecting rotation of a plurality of spray arms using a rotation detection system. In this regard, continuing example from above, rotation detection system 240 may use rotation sensors 242 to monitor the rotation of lower spray arm 210 and upper spray arm 212. According to an exemplary embodiment, controller 160 may use rotation detection system 240 to determine a rotation speed of each of the spray arm 210, 212. In addition, controller 160 may determine that a rotation speed of one of the lower spray arm 210 and upper spray arm 212 exceeds a predetermined speed threshold and thus conclude that diverter assembly 220 is providing the flow of wash fluid 206 to that spray arm.

Specifically, step 320 includes determining a position of the diverter assembly based at least in part on the rotation detected by the rotation system. Thus, by monitoring the rotation of spray arms 210, 212, controller 160 may determine a position of diverter assembly 220 without necessitating the use of an internal position sensor within diverter assembly 220.

Notably, according to exemplary embodiments, in addition to monitoring the rotation of lower spray arm 210 and upper spray arm 212, rotation detection system 240 may also be used to determine other fault conditions within dishwasher appliance 100 and/or diverter assembly 220. In this regard, for example, step 330 may include determining that the diverter assembly is malfunctioning if the diverter assembly is attempting to change position (e.g., such as when the controller 160 is commanding the diverter to change position) but the rotation detection system senses no change in rotation of the plurality of spray arms. In this regard, for example, if the controller 160 is repeatedly sending a command to switch diverter positions while the flow of wash fluid 206 continues to discharge from and rotate lower spray arm 210, controller 160 may determine that diverter assembly 220 is stuck in the lower spray position.

In addition, step 340 may include determining that one of the plurality of spray arms is stuck if the diverter assembly is changing position but one of the plurality spray arms is not rotating. In this regard, for example, if the diverter is changing position and one spray arm is periodically rotating while the other is always stationary, controller 160 may determine that the spray arm is stuck. Each of these conditions may be followed by controller 160 providing a user notification or otherwise implementing corrective action. In this regard, controller 160 may illuminate a status indicator on control panel 162, may communicate a default indication to the user via a mobile device, or may contact a maintenance technician for repair.

FIG. 4 depicts steps performed in a particular order for purposes of illustration and discussion. Those of ordinary skill in the art, using the disclosures provided herein, will understand that the steps of any of the methods discussed herein can be adapted, rearranged, expanded, omitted, or modified in various ways without deviating from the scope of the present disclosure. Moreover, although aspects of method 300 are explained using dishwasher appliance 100 as an example, it should be appreciated that these methods may be applied to the operation of any suitable dishwasher, washing machine appliance, or other appliance where diverter assemblies are used.

Figure 5:
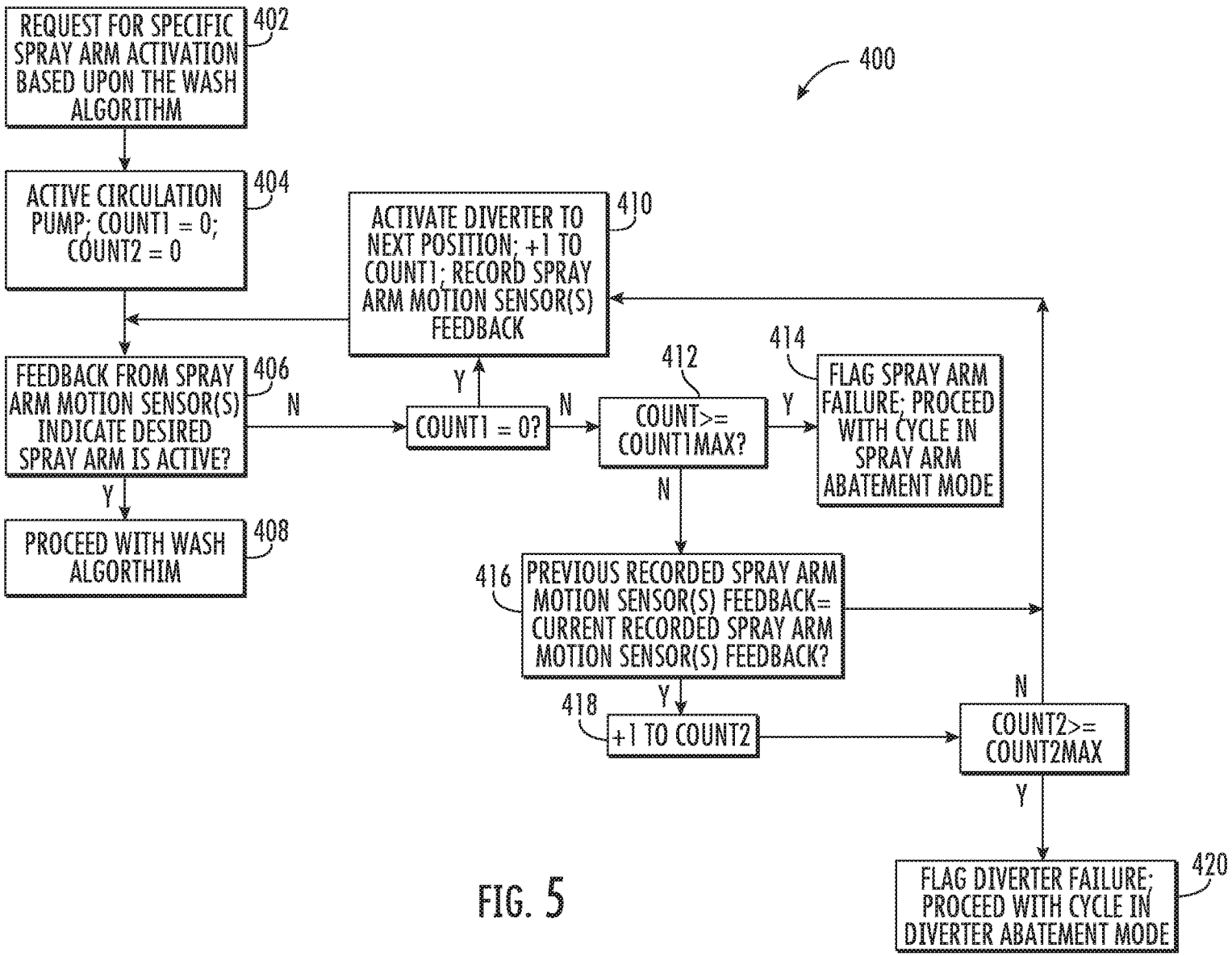
FIG. 5 provides a flow chart for operating the exemplary fluid circulation assembly of FIG. 3 in accordance with an exemplary embodiment of the present subject matter.

Referring now briefly to FIG. 5, an exemplary flowchart or control algorithm 400 that may be used by controller 160 to implement method 300 or otherwise operate diverter assembly 220 will be described according to an exemplary embodiment. Specifically, as shown, algorithm 400 commences when controller receives a request for a specific spray arm to activate, e.g., based on the operating cycle or wash algorithm (step 402). At step 404, a first counter and a second counter are both set to zero and at step 406, rotation detection system 240 may provide feedback regarding the rotation of the spray arms. If a motion sensor associated with the desired spray arm indicates rotation, step 408 includes proceeding with the operating cycle or wash algorithm. By contrast, if the desired spray arm is not rotating, the first counter is incremented by one and the diverter is incremented to the next position (step 410). This process is repeated unless the first counter is exceeds a first counter maximum at step 412 in which case a fault indication is provided at step 414. As long as the first counter remains lower than the first counter maximum, step 416 includes determining whether the previously recorded spray arm motion sensor feedback is equivalent to the current recorded spray arm feedback. If the previous and current feedback is different, the diverter is activated to the next position at step 410. By contrast, if the previously and currently recorded feedback is the same the second counter is incremented by one at step 418. This process is repeated until the second counter exceeds a second counter maximum which results in a fault indication at step 420 that indicates diverter failure. It should be appreciated that the steps in algorithm 400 are only exemplary and not intended to limit the scope of the present subject matter.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal language of the claims.

What is claimed is:

1. A dishwasher appliance comprising:

a wash tub that defines a wash chamber;

a sump for collecting wash fluid;

a circulation pump in fluid communication with the sump for urging a flow of wash fluid through a supply conduit;

a plurality of spray arms rotatably mounted within the wash chamber;

a diverter assembly operably coupled to the supply conduit for selectively diverting the flow of wash fluid to the plurality of spray arms;

one or more rotation sensors for detecting rotation of the plurality of spray arms; and a controller in operative communication with the one or more rotation sensors, the controller being configured for:

detecting rotation of the plurality of spray arms using the one or more rotation sensors; and determining a position of the diverter assembly based at least in part on the rotation detected by the one or more rotation sensors.

2. The dishwasher appliance of claim 1, wherein each of the one or more rotation sensors is configured for monitoring the rotation of one of the plurality of spray arms.

3. The dishwasher appliance of claim 2, wherein at least one of the one or more rotation sensors is positioned proximate a back of the wash tub.

4. The dishwasher appliance of claim 1, wherein detecting the rotation of the plurality of spray arms comprises:

measuring a rotation speed of the plurality of spray arms; and determining that the rotation speed of one of the plurality of spray arms exceeds a predetermined speed threshold.

5. The dishwasher appliance of claim 1, wherein the one or more rotation sensors comprises:

a plurality of magnets, each of the plurality of magnets being mounted on one of the plurality of spray arms; and a plurality of reed switches, each of the plurality of reed switches being positioned on the wash tub such that one of the plurality of magnets passes over the reed switch during each rotation.

6. The dishwasher appliance of claim 1, wherein the controller is configured for:

determining that diverter assembly is malfunctioning if the diverter assembly is attempting to change position but the one or more rotation sensors senses no change in rotation of the plurality of spray arms.

7. The dishwasher appliance of claim 1, wherein the controller is configured for:

determining that one of the plurality of spray arms is stuck if the diverter assembly is changing position but one of the plurality of spray arms is not rotating.

8. The dishwasher appliance of claim 1, wherein the diverter assembly does not include a dedicated position sensor.

9. A fluid circulation assembly for a dishwasher appliance, the dishwasher appliance comprising a sump for collecting wash fluid, the fluid circulation assembly comprising:

a supply conduit fluidly coupled to the sump;

a plurality of spray arms rotatably mounted within the wash tub and being fluidly coupled to the supply conduit;

a pump for urging a flow of wash fluid from the sump through the supply conduit;

one or more rotation sensors for detecting rotation of the plurality of spray arms; and a diverter assembly operably coupled to the supply conduit, the diverter assembly comprising:

a diverter housing defining a diverter chamber and a plurality of outlets, each outlet being fluidly coupled with one of the plurality of spray arms; and a diverter disc rotatably mounted within the diverter chamber and being movable to a plurality of positions for selectively directing the flow of wash fluid to the plurality of spray arms.

10. The fluid circulation assembly of claim 9, wherein each of the one or more rotation sensors is configured for monitoring the rotation of one of the plurality of spray arms.

11. The fluid circulation assembly of claim 10, wherein at least one of the one or more rotation sensors is positioned proximate a back of the wash tub.

12. The fluid circulation assembly of claim 9, wherein detecting the rotation of the plurality of spray arms comprises:

measuring a rotation speed of the plurality of spray arms; and determining that the rotation speed of one of the plurality of spray arms exceeds a predetermined speed threshold.

13. The fluid circulation assembly of claim 9, wherein the one or more rotation sensors comprises:

a plurality of magnets, each of the plurality of magnets being mounted on one of the plurality of spray arms; and a plurality of reed switches, each of the plurality of reed switches being positioned on the wash tub such that one of the plurality of magnets passes over the reed switch during each rotation.

14. The fluid circulation assembly of claim 9, wherein the controller is configured for:

determining that diverter assembly is malfunctioning if the diverter assembly is attempting to change position but the one or more rotation sensors senses no change in rotation of the plurality of spray arms.

15. The fluid circulation assembly of claim 9, wherein the controller is configured for:

determining that one of the plurality of spray arms is stuck if the diverter assembly is changing position but one of the plurality of spray arms is not rotating.

16. The fluid circulation assembly of claim 9, wherein the diverter assembly does not include a dedicated position sensor.

17. A method of determining a position of a diverter assembly in a dishwasher appliance, the method comprising:

detecting rotation of a plurality of spray arms using one or more rotation sensors; and determining the position of the diverter assembly based at least in part on the rotation detected by the one or more rotation sensors.

18. The method of claim 17, wherein detecting the rotation of the plurality of spray arms comprises:

measuring a rotation speed of the plurality of spray arms; and determining that the rotation speed of one of the plurality of spray arms exceeds a predetermined speed threshold.

19. The method of claim 17, further comprising:

determining that diverter assembly is malfunctioning if the diverter assembly is attempting to change position but the one or more rotation sensors senses no change in rotation of the plurality of spray arms.

20. The method of claim 17, further comprising:

determining that one of the plurality of spray arms is stuck if the diverter assembly is changing position but one of the plurality of spray arms is not rotating.

* * * * *